US011440208B2

(12) United States Patent
Sakon et al.

(10) Patent No.: US 11,440,208 B2
(45) Date of Patent: Sep. 13, 2022

(54) BLADE OF HAIR REMOVAL DEVICE AND HAIR REMOVAL DEVICE INCLUDING BLADE OF HAIR REMOVAL DEVICE

(71) Applicant: PANASONIC INTELLECTUAL PROPERTY MANAGEMENT CO., LTD., Osaka (JP)

(72) Inventors: Shigetoshi Sakon, Shiga (JP); Kazuhiro Morisugi, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 23 days.

(21) Appl. No.: 17/116,172

(22) Filed: Dec. 9, 2020

(65) Prior Publication Data

US 2021/0252725 A1 Aug. 19, 2021

(30) Foreign Application Priority Data

Feb. 14, 2020 (JP) ..... JP2020-023370

(51) Int. Cl.
*B26B 19/38* (2006.01)
*B26B 19/06* (2006.01)
*B26B 19/20* (2006.01)

(52) U.S. Cl.
CPC ..... *B26B 19/3846* (2013.01); *B26B 19/06* (2013.01); *B26B 19/20* (2013.01)

(58) Field of Classification Search
CPC ..... B26B 19/3846; B26B 19/20; B26B 19/06
USPC ..... 30/223
See application file for complete search history.

(56) References Cited

U.S. PATENT DOCUMENTS 4,221,049 A * 9/1980 Hamashima ..... B26B 19/06 30/195
6,658,740 B2 * 12/2003 Habben ..... B26B 19/06 30/223
9,789,617 B2 * 10/2017 Stapelbroek ..... B26B 19/06
10,252,429 B2 * 4/2019 Sablatschan ..... B26B 19/3846
2008/0052915 A1 * 3/2008 Fukutani ..... B26B 19/3846 30/241

(Continued)

FOREIGN PATENT DOCUMENTS

EP 3 002 094 A1 4/2016
EP 3 865 259 A1 * 8/2021
JP 2016-067648 A 5/2016

*Primary Examiner* — Hwei-Siu C Payer
(74) *Attorney, Agent, or Firm* — McDermott Will & Emery LLP

(57) ABSTRACT

A blade of a hair removal device according to the present disclosure includes a fixed blade having a fixed blade bar and a fixed blade groove, and a movable blade having a movable blade bar and a movable blade groove. The movable blade bar is formed such that a bar width in a reciprocating sliding direction is larger than a groove width of the fixed blade groove in the reciprocating sliding direction. In the fixed blade bar, a bar width in the reciprocating sliding direction is larger than a groove width of the movable blade groove in the reciprocating sliding direction. In the fixed blade groove and the movable blade groove, a blade groove angle at least on an opening side is a positive angle with an intersection positioned on a depth side. This configuration provides a blade of a hair removal device capable of suppressing deformation.

11 Claims, 11 Drawing Sheets

(56) References Cited

U.S. PATENT DOCUMENTS

| | | | | |
|---|---|---|---|---|
| 2009/0126201 | A1* | 5/2009 | Melton | B26B 19/3846 30/223 |
| 2009/0320296 | A1* | 12/2009 | Morisugi | B26B 19/3846 30/45 |
| 2014/0102271 | A1* | 4/2014 | Krenik | B26B 19/388 83/13 |
| 2021/0252725 | A1* | 8/2021 | Sakon | B26B 19/3846 |

* cited by examiner

BLADE OF HAIR REMOVAL DEVICE AND HAIR REMOVAL DEVICE INCLUDING BLADE OF HAIR REMOVAL DEVICE

CROSS-REFERENCE OF RELATED APPLICATIONS

This application claims the benefit of Japanese Application No. 2020-023370, filed on Feb. 14, 2020, the entire disclosure of which Application is incorporated by reference herein.

BACKGROUND

1. Technical Field

The present disclosure relates to a blade of a hair removal device and a hair removal device including the blade of the hair removal device.

2. Description of the Related Art

Conventionally, as disclosed in Unexamined Japanese Patent Publication No. 2016-067648, there has been proposed a blade of a trimmer (hair removal device) for cutting hair by reciprocating a comb-shaped movable blade having a movable blade bar and a movable blade groove, with respect to a comb-shaped fixed blade having a fixed blade bar and a fixed blade groove.

In this Unexamined Japanese Patent Publication No. 2016-067648, when one movable blade bar is positioned on the fixed blade groove formed between two adjacent fixed blade bars, a movable blade bar adjacent to the one movable blade bar is brought into contact with the fixed blade bar or another fixed blade bar. This configuration allows the movable blade bar and the fixed blade bar in contact with each other to receive a force applied to the movable blade bar or the fixed blade bar with the one movable blade bar positioned on the fixed blade groove, and makes it possible to suppress deformation of the movable blade bar or the fixed blade bar.

SUMMARY

As described above, even with the conventional technique, it is possible to suppress deformation of the blade of the trimmer (hair removal device). However, it is desirable to make it possible to suppress deformation of the blade of the trimmer (hair removal device) more reliably.

Therefore, an object of the present disclosure is to obtain a blade of a hair removal device capable of more reliably suppressing deformation, and a hair removal device including the blade of the hair removal device.

A blade of a hair removal device according to one aspect of the present disclosure includes a fixed blade and a movable blade that reciprocatingly slides with respect to the fixed blade, and the blade of the hair removal device cuts hair with the fixed blade and the movable blade. Further, the fixed blade has a plurality of fixed blade bars arranged side by side in a reciprocating sliding direction of the movable blade with respect to the fixed blade, and a plurality of fixed blade grooves arranged side by side in the reciprocating sliding direction. Further, the movable blade has a plurality of movable blade bars arranged side by side in the reciprocating sliding direction, and a plurality of movable blade grooves arranged side by side in the reciprocating sliding direction. Further, the movable blade bar is formed such that a bar width in the reciprocating sliding direction is larger than a groove width of the fixed blade groove in the reciprocating sliding direction. The fixed blade bar is formed such that a bar width in the reciprocating sliding direction is larger than a groove width of the movable blade groove in the reciprocating sliding direction. The fixed blade groove and the movable blade groove are formed such that a blade groove angle at least on an opening side is a positive angle with an intersection positioned on a depth side.

A blade of a hair removal device according to another aspect of the present disclosure includes a fixed blade and a movable blade that reciprocatingly slides with respect to the fixed blade, and the blade of the hair removal device cuts hair with the fixed blade and the movable blade. Further, the fixed blade has a plurality of fixed blade bars arranged side by side in a reciprocating sliding direction of the movable blade with respect to the fixed blade, and a plurality of fixed blade grooves arranged side by side in the reciprocating sliding direction. Further, the movable blade has a plurality of movable blade bars arranged side by side in the reciprocating sliding direction, and a plurality of movable blade grooves arranged side by side in the reciprocating sliding direction. Further, the fixed blade bar includes a fixed-side hair cutting region capable of cutting hair, and the movable blade bar includes a movable-side hair cutting region capable of cutting hair. Then, when a center of the movable blade bar in the reciprocating sliding direction is made coincident with a center of the fixed blade groove in the reciprocating sliding direction in viewing along an overlapping direction of the fixed blade and the movable blade, edges on both sides of the movable-side hair cutting region in the reciprocating sliding direction are overlapped with the fixed-side hair cutting region. Further, when a center of the fixed blade bar in the reciprocating sliding direction is made coincident with a center of the movable blade groove in the reciprocating sliding direction in viewing along an overlapping direction of the fixed blade and the movable blade, edges on both sides of the fixed-side hair cutting region in the reciprocating sliding direction are overlapped with the movable-side hair cutting region.

A hair removal device according to one aspect of the present disclosure includes the blade of the hair removal device described above.

According to the present disclosure, it is possible to obtain a blade of a hair removal device capable of more reliably suppressing deformation, and a hair removal device including the blade of the hair removal device.

DETAILED DESCRIPTION

Hereinafter, an exemplary embodiment will be described in detail with reference to the drawings. However, more detailed description than necessary may be omitted. For example, detailed descriptions of well-known matters or redundant explanations for substantially the same configuration may be omitted.

It is to be noted that the accompanying drawings and the following description are provided to enable those skilled in the art to fully understand the present disclosure, and are not intended to limit the claimed subject matter by the accompanying drawings and the following description.

Further, in the following exemplary embodiment, as a hair removal device, a trimmer (electric hair cutting device) to cut hair or body hair of a human or an animal is exemplified.

Here, in the present exemplary embodiment, a longitudinal direction of a grip part of the trimmer is defined as up-down direction Z, a width direction of the grip part of the trimmer is defined as width direction Y, and a direction orthogonal to up-down direction Z and width direction Y is defined as front-rear direction X.

Further, in the present exemplary embodiment, a side of the grip part where a head part is arranged is defined as an upper side in the up-down direction, and a side of the grip part where a switch part is provided is defined as a front side in the front-rear direction.

Moreover, in the present exemplary embodiment, a linear reciprocating direction of the movable blade (a reciprocating sliding direction of the movable blade) is defined as blade moving direction W.

Exemplary Embodiment

Figure 1:
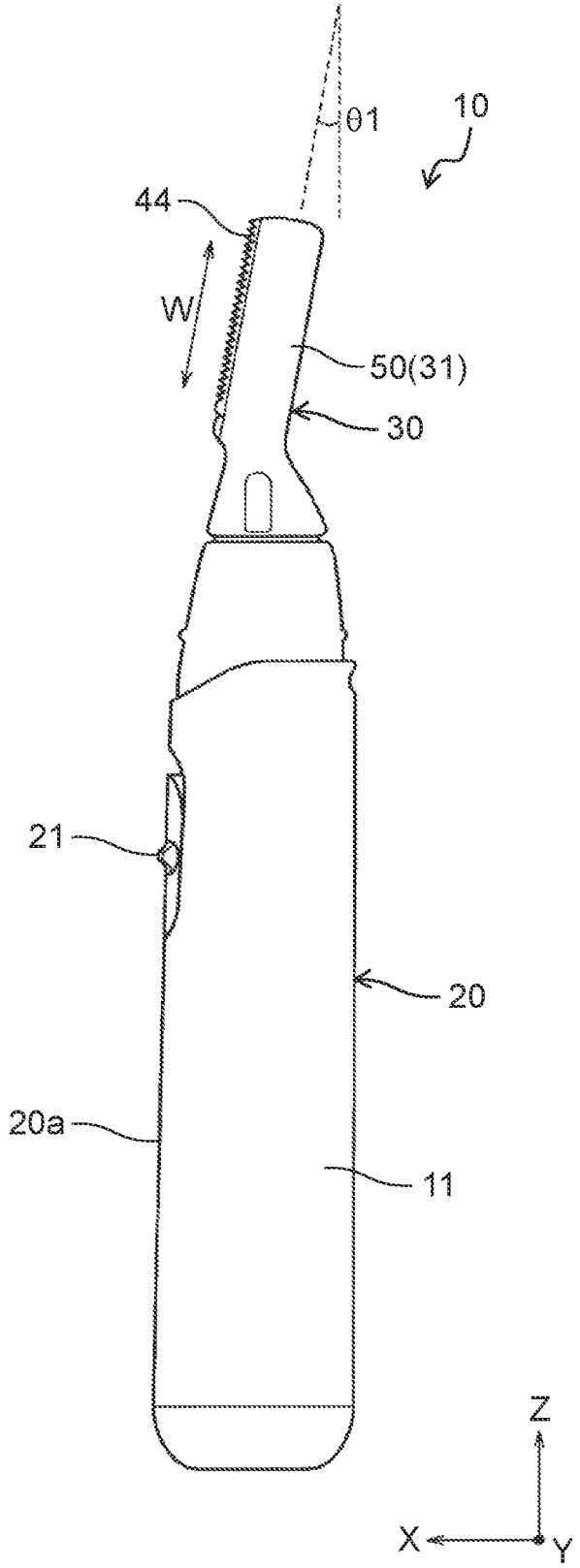
FIG. 1 is a side view showing a trimmer according to an exemplary embodiment.

As shown in FIG. 1, trimmer (hair removal device) 10 according to the present exemplary embodiment is provided with grip part 20 that can be gripped by a hand, and blade unit 40, Further, trimmer 10 includes head part 30 supported by grip part 20. This trimmer 10 is, for example, a device that cuts body hair of a user or the like (for example, eyebrows or the like) to a desired length, to treat or trim the body hair of the user or the like.

Further, in the present exemplary embodiment, trimmer 10 includes housing 11 made of synthetic resin, and this housing 11 is formed by joining a plurality of divided bodies. Then, a cavity is formed in housing 11 formed by joining the divided bodies, and this cavity accommodates various electric components. These plurality of divided bodies can be joined by using screws or by fitting the divided bodies together, for example.

In the present exemplary embodiment, the cavity formed inside of housing 11 accommodates an electric motor (not shown), a power supply unit (not shown) that drives the electric motor, and the like. Moreover, the cavity formed inside of housing 11 accommodates notion converter 60 that converts a rotational motion of the electric motor into a translational motion. As this motion converter 60, a conventionally known motion converter can be used. In the present exemplary embodiment, there is provided arm part 61 connected to drive pole 43*a* of bush 43, which will be described later. Motion converter 60 that converts a rotational motion of the electric motor into a linear reciprocating motion of arm part 61 is accommodated inside of housing 11.

Further, as described above, in the present exemplary embodiment, trimmer 10 includes grip part 20 and head part 30.

Grip part 20 has an elongated cylindrical shape in up-down direction Z, and is formed in a size that allows a user to grip with one hand.

Figure 2:
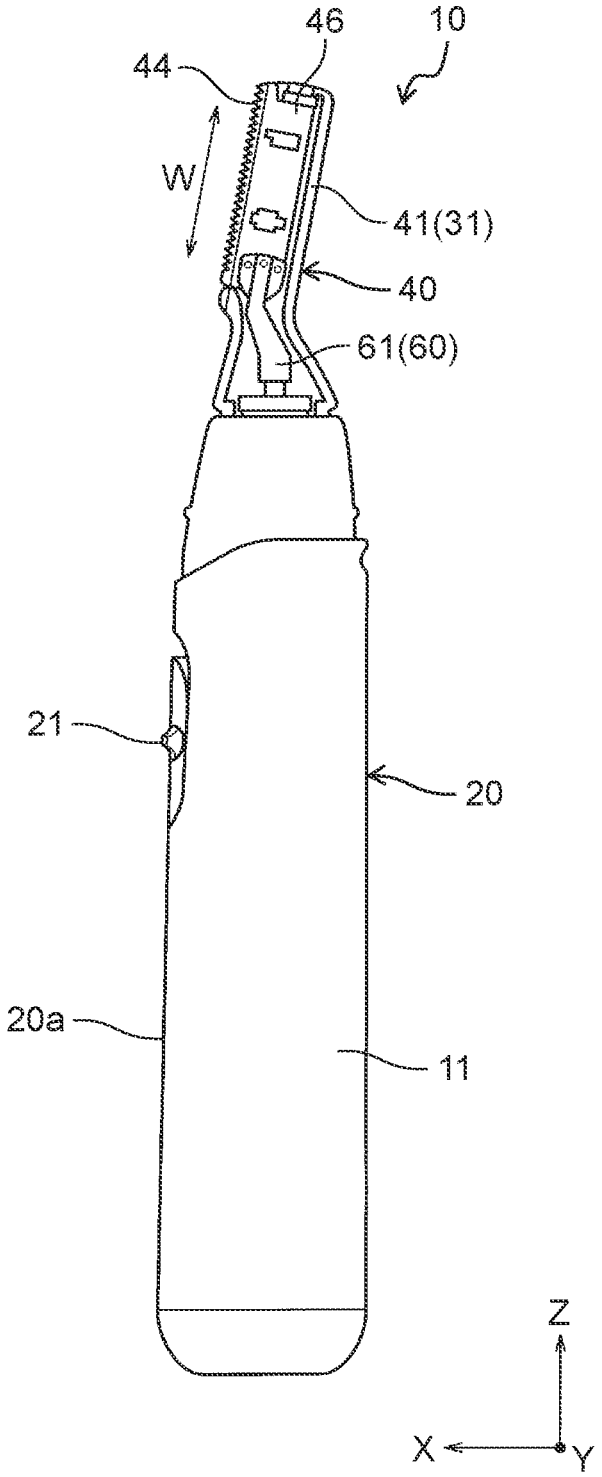
FIG. 2 is a side view showing a state where a cover of the trimmer according to the exemplary embodiment is removed.
Figure 5:
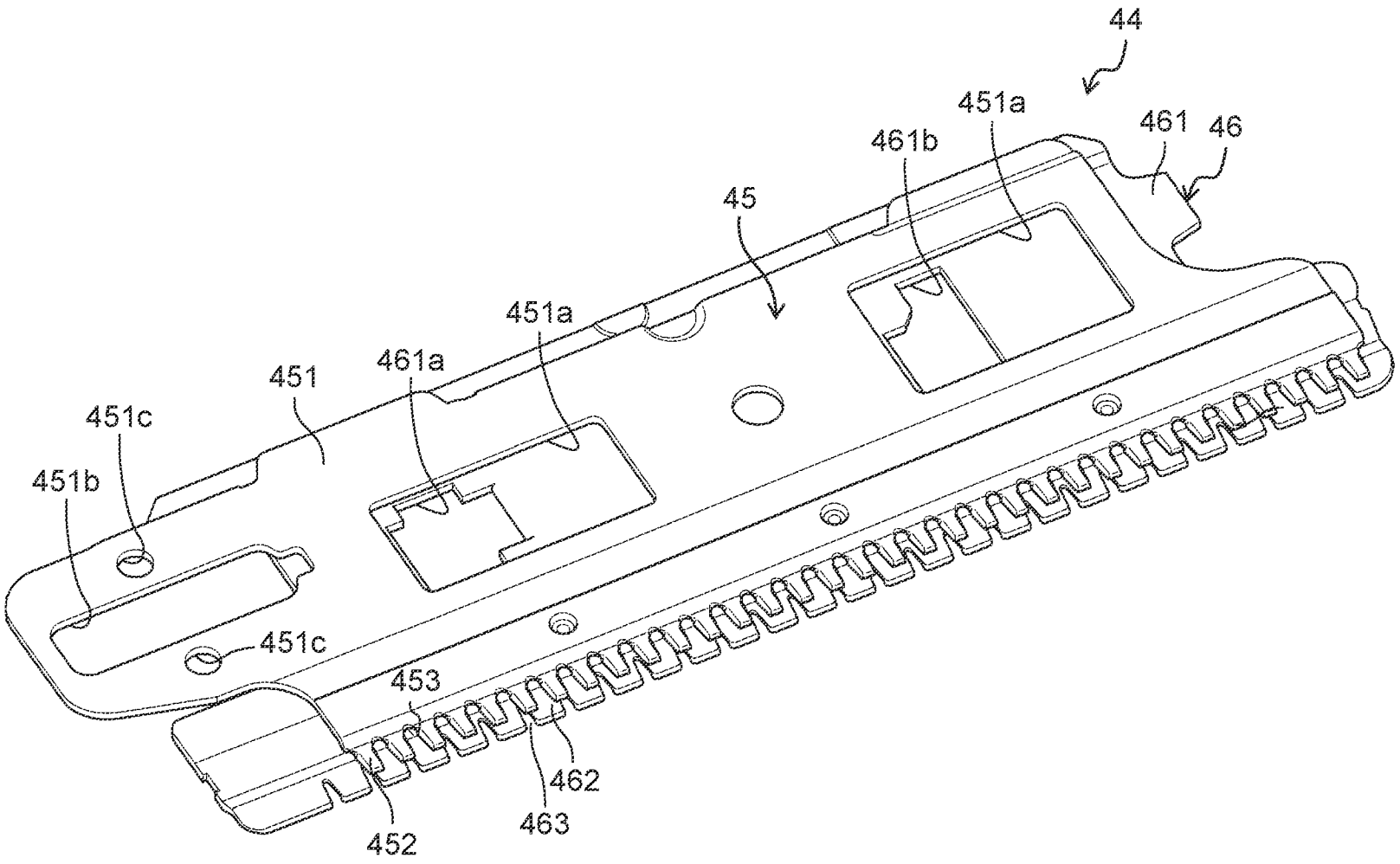
FIG. 5 is a perspective view of a fixed plate and a movable plate according to the exemplary embodiment as viewed from the movable-plate side.
Figure 6:
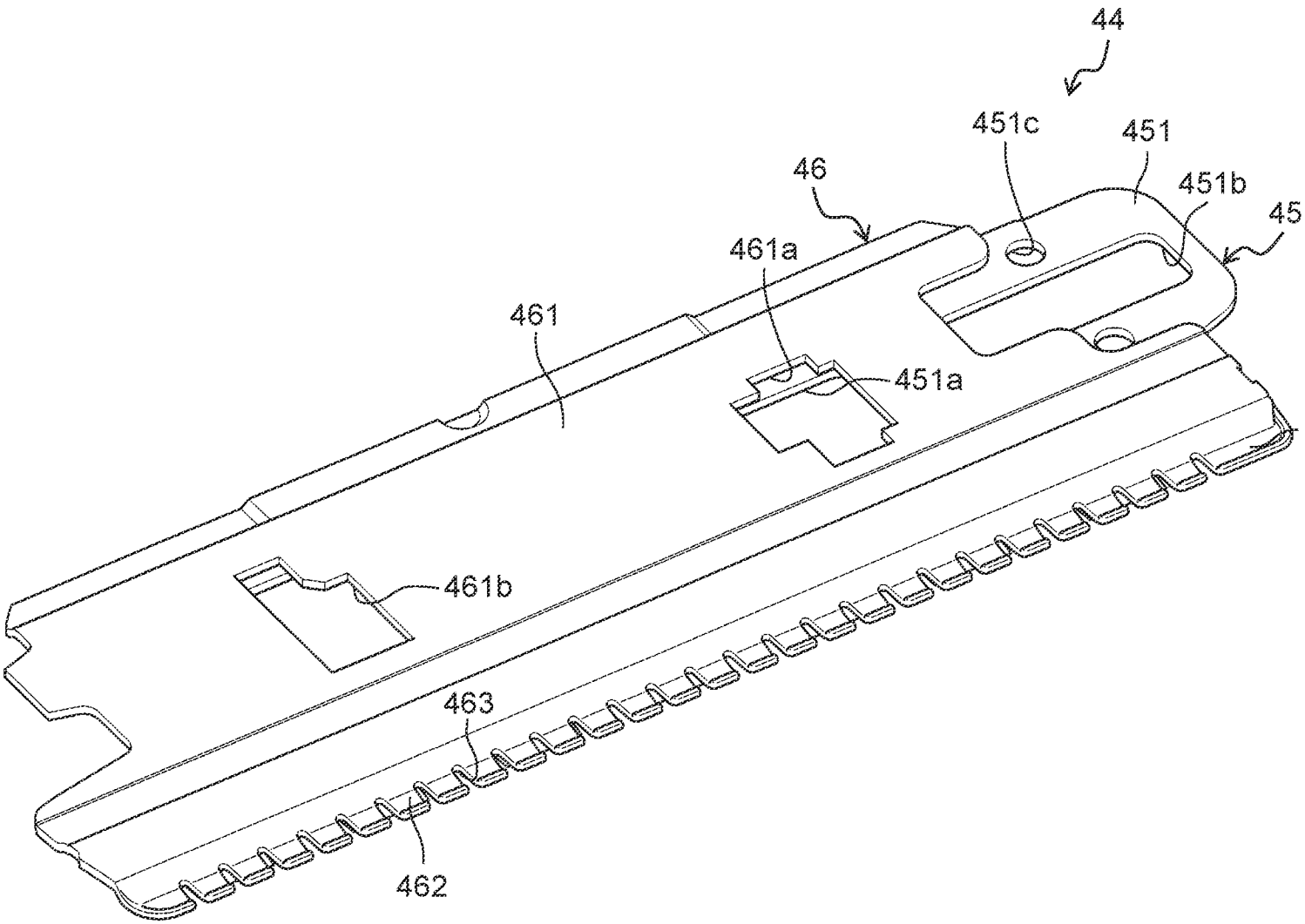
FIG. 6 is a perspective view of the fixed plate and the movable plate according to the exemplary embodiment as viewed from the fixed-plate side.

Head part 30 is integrally and continuously provided with grip part 20 on the upper side in up-down direction Z, and this head part 30 is provided with blade unit 40 (see FIG. 2). In the present exemplary embodiment, blade unit 40 has a function of cutting hair, and includes, as shown in FIGS. 5 and 6, blade part (a blade of the hair removal device) 44 formed by arranging movable plate (movable blade) 45 and fixed plate (fixed blade) 46 to be opposed to each other. This blade part 44 is configured such that movable blade bar 452 described later of movable plate 45 reciprocatingly slides in blade moving direction W with respect to fixed blade bar 462 described later of fixed plate 46.

Figure 3:
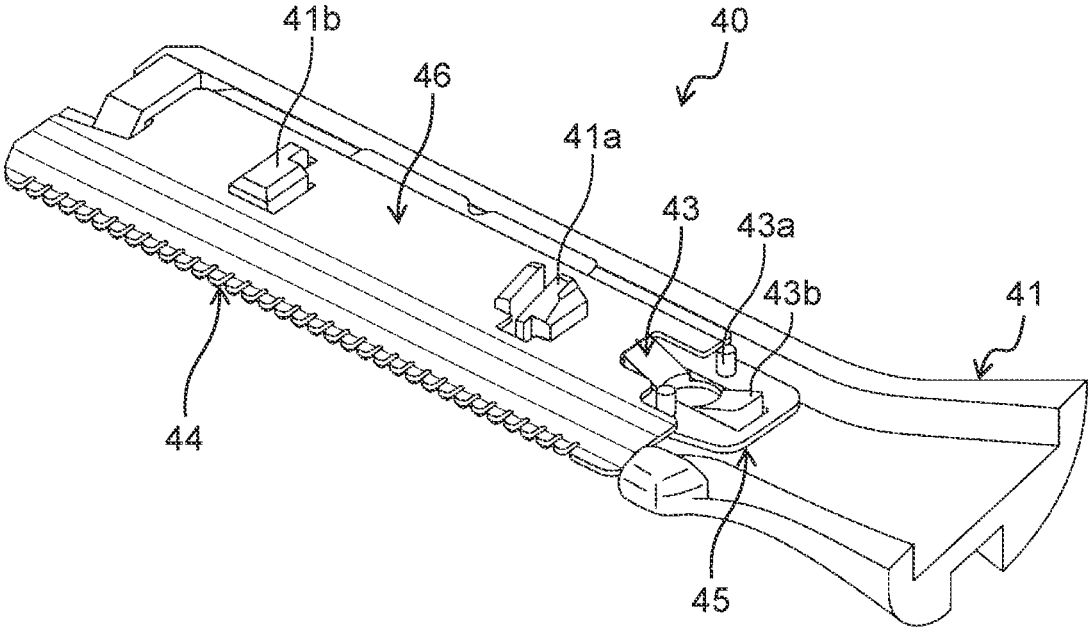
FIG. 3 is a perspective view showing a blade unit according to the exemplary embodiment.
Figure 4:
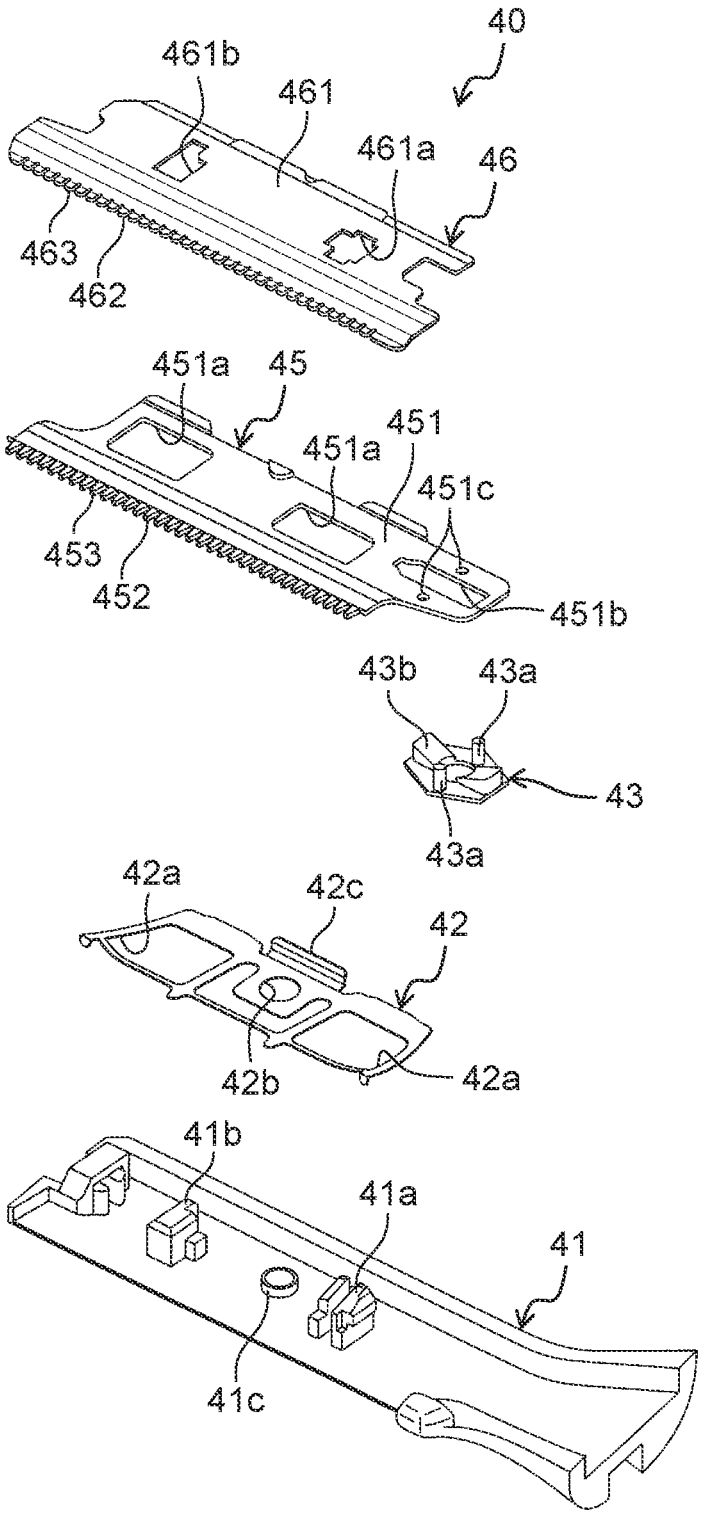
FIG. 4 is a perspective view showing the blade unit according to the exemplary embodiment in an exploded manner.

Further, as shown in FIGS. 3 and 4, blade unit 40 includes base part 41 made of synthetic resin where blade part 44 is arranged. Further, blade unit 40 includes pressing spring 42 pressing movable plate 45 toward fixed plate 46, and bush 43 fixed to movable plate 45 by heat-sealing.

Base part 41 is a member that forms a part of an outer shell of head part 30, with blade unit 40 attached to grip part 20 (see FIG. 2). This base part 41 includes: hook part 41*a* that engages with fixed plate 46 to suppress come-off of fixed plate 46 from base part 41; positioning protrusion 41*b* that suppresses misalignment of fixed plate 46; and rib 41*c* that suppresses misalignment of pressing spring 42.

Pressing spring 42 is a member to cause movable blade bar 452 and fixed blade bar 462 to slide more reliably, by pressing movable plate 45 toward a fixed plate 46 side. This pressing spring 42 includes: insertion hole 42*a* to be inserted with hook part 41*a* and positioning protrusion 41*b*; positioning hole 42*b* to be inserted with rib 41*c*; and fixing piece 42*e* positioned in width direction Y (see FIG. 1) by fixed plate 46. In the present exemplary embodiment, insertion hole 42*a* is formed so as to be larger than hook part 41*a* and positioning protrusion 41*b*. Further, positioning hole 42*b* is formed such that an inner diameter is substantially the same as an outer diameter of positioning protrusion 41*b*, Therefore, by inserting positioning protrusion 41*b* into positioning hole 42*b*, pressing spring 42 is positioned with respect to base part 41.

Bush 43 is a drive connecting member attached to movable plate 45. This bush 43 includes a pair of drive poles 43*a* to which arm part 61 of motion converter 60 is connected, and protrusion 43*b* formed between the pair of drive poles 43*a*.

Movable plate 45 includes main body 451. This main body 451 is formed with: insertion hole 451*a* to be inserted with hook part 41*a* and positioning protrusion 41*b*; insertion hole 451*b* to be inserted with protrusion 43*b*; and a pair of insertion holes 451*c* to be respectively inserted with the pair of drive poles 43*a*. Then, bush 43 is fixed to movable plate 45 by applying heat-sealing processing, in a state where protrusion 43*b* is inserted into insertion hole 451*b*, and the pair of drive poles 43*a* are respectively inserted into the pair of insertion holes 451*c*.

Note that, in the present exemplary embodiment, insertion hole 451*a* is formed so as to be larger than hook part 41*a* and positioning protrusion 41*b*. Then, movable plate 45 is made capable of reciprocating with respect to base part 41 in at least blade moving direction W, in a state where hook part 41*a* and positioning protrusion 41*b* are inserted through insertion hole 451*a*.

In addition, on one end side of main body 451, movable plate 45 includes a plurality of movable blade bars 452 arranged side by side in blade moving direction W, and a plurality of movable blade grooves 453 formed between adjacent movable blade bars 452.

Fixed plate 46 includes main body 461. This main body 461 is formed with engagement hole 461*a* that engages with hook part 41*a*, and insertion hole 461*b* to be inserted with positioning protrusion 41*b*. Then, by inserting positioning protrusion 41*b* into insertion hole 461*b* while engaging hook part 41*a* with engagement hole 461*a*, fixed plate 46 is fixed to base part 41. At this time, fixed plate 46 is fixed to base part 41 in a state where a relative motion in blade moving direction W with respect to base part 41 is restricted.

In addition, on one end side of main body 461, fixed plate 46 includes a plurality of fixed blade bars 462 arranged side by side in blade moving direction W, and a plurality of fixed blade grooves 463 formed between adjacent fixed blade bars 462.

Blade unit 40 having such a configuration can be assembled by, for example, a method shown below. Note that the method shown below is merely an example, and blade unit 40 can be assembled by various methods.

First, by inserting positioning protrusion 41*b* into positioning hole 42*b* while inserting hook part 41*a* and positioning protrusion 41*b* of base part 41 into insertion hole 42*a* of pressing spring 42, pressing spring 42 is attached to base part 41 in a positioned state.

Next, bush 43 is integrated with movable plate 45 by applying heat-sealing processing, in a state where protrusion 43*b* is inserted into insertion hole 451*b*, and the pair of drive poles 43*a* are respectively inserted into the pair of insertion holes 451*c*. Note that, it is also possible to assemble blade unit 40 after preparing bush 43 integrated with movable plate 45 in advance.

Next, by inserting hook part 41*a* and positioning protrusion 41*b* of base part 41 into insertion hole 451*a* of movable plate 45 to which bush 43 is integrated, movable plate 45 is arranged on pressing spring 42.

Next, by inserting positioning protrusion 41*b* into insertion hole 461*b* while engaging hook part 41*a* of base part 41 with engagement hole 461*a* of fixed plate 46, fixed plate 46 is fixed to base part 41. At this time, fixing piece 42*c* of pressing spring 42 is positioned in width direction Y (see FIG. 1) by an end of fixed plate 46 on a root side (a side opposite to a side where fixed blade bar 462 and fixed blade groove 463 are formed).

With this process, blade unit 40 shown in FIG. 3 is assembled.

Then, in the present exemplary embodiment, blade unit 40 shown in FIG. 3 is detachably attached to grip part 20. Note that, in the present exemplary embodiment, in a state where blade unit 40 is attached to grip part 20, movable blade bar 452 and fixed blade bar 462 project on the front side in front-rear direction X.

Further, blade unit 40 is attached to grip part 20 in a state where drive pole 43*a* of bush 43 is connected to arm part 61. This configuration allows movable plate 45 to reciprocate with respect to fixed plate 46 in blade moving direction W in conjunction with reciprocating sliding of arm part 61 in blade moving direction W, when the electric motor is driven.

Then, by covering the fixed plate 46 side with cover 50 in a state where blade unit 40 is attached to grip part 20, head part 30 having blade part 44 is formed. At this time, a tip end side of movable blade bar 452 and fixed blade bar 462 (movable-side hair cutting region 4524 and fixed-side hair cutting region 4624 described later) are exposed from housing 31 included in the outer shell of head part 30.

Further, in the present exemplary embodiment, trimmer 10 is configured such that angle θ1 (see FIG. 1) formed by blade moving direction (the reciprocating sliding direction of the movable blade) W and the up-down direction (a longitudinal direction of grip part 20) is an acute angle. This angle θ1 is determined based on operability at a time of cutting hair with use of trimmer 10, and is desirably less than or equal to 45°.

This configuration makes it possible to reduce a difference between operation feeling when trimmer 10 is moved in one direction of width direction Y which is a main operation direction, and operation feeling when trimmer 10 is moved in another direction of width direction Y. As a result, trimmer 10 can be used in both directions on one side and another side in width direction Y without any discomfort, which can improve usability of trimmer 10.

Figure 13:
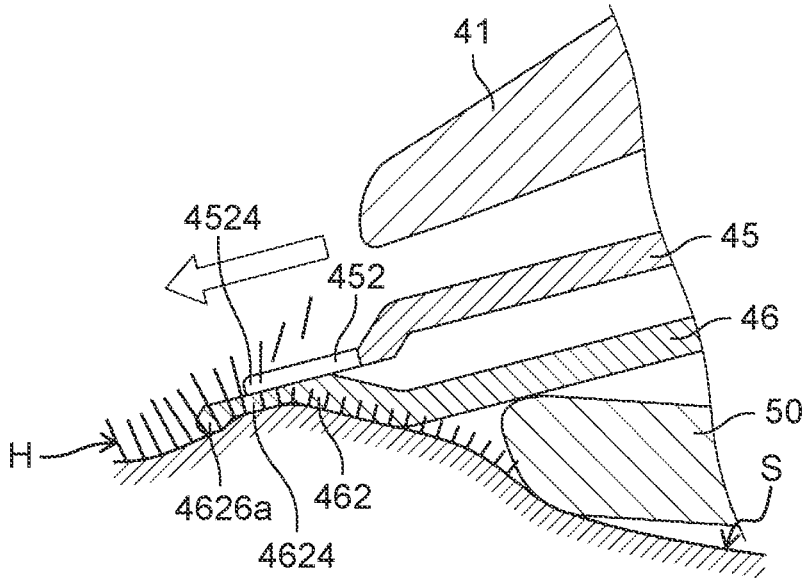
FIG. 13 is a cross-sectional view showing an example of use with the fixed blade bar of the trimmer according to the exemplary embodiment being applied on skin.

Specifically, as shown in FIG. 13, it is made possible to cut hair H by applying the fixed plate (fixed blade) 46 side of blade part (the blade of the hair removal device) 44 on skin (skin surface) 5, which is an example of a target site.

Figure 14:
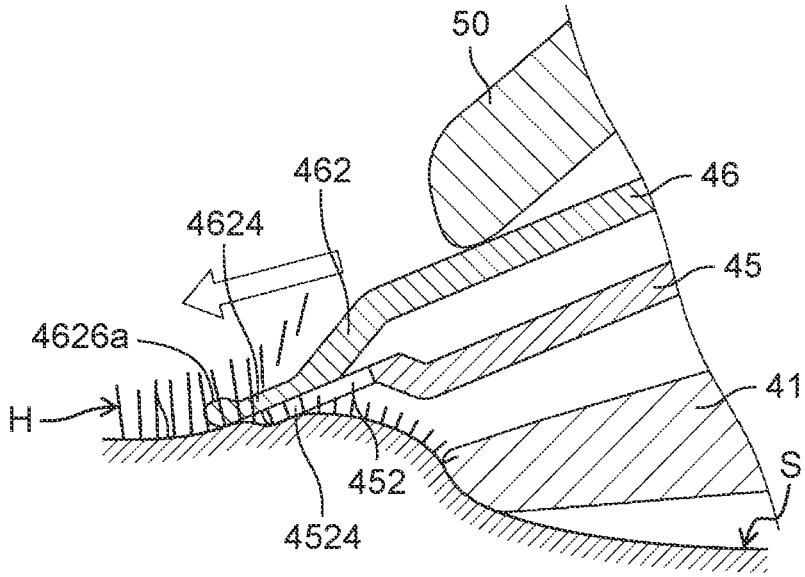
FIG. 14 is a cross-sectional view showing an example of use with the movable blade bar of the trimmer according to the exemplary embodiment being applied on skin.

Further, as shown in FIG. 14, it is also made possible to cut hair H by applying a movable plate (movable blade) 45 side of blade part (the blade of the hair removal device) 44 on skin (skin surface) S, which is an example of a target site.

Further, in the present exemplary embodiment, housing 11 is formed with sliding operation switch 21 that operates trimmer 10 (turns on and off power supply). Note that, in the present exemplary embodiment, sliding operation switch 21 is exemplified as a switch, but a pressing switch or other switch may be used as long as the switch can turn on and off the power supply.

In the present exemplary embodiment, operation switch 21 is provided on front surface (a front surface: an outer surface) 20*a* of grip part 20 so as to be slidable in up-down direction Z. Specifically, the power supply of trimmer 10 can be switched from off to on by sliding of operation switch 21 from the lower side to the upper side in up-down direction Z. Further, the power supply of trimmer 10 can be switched from on to off by sliding of operation switch 21 from the upper side to the lower side in up-down direction Z.

As described above, in the present exemplary embodiment, the power supply of trimmer 10 is switched from off to on by sliding of operation switch 21 toward the upper side. Then, when the power supply of trimmer 10 is switched from off to on, the electric motor is driven, and a rotation of the electric motor is converted into a linear reciprocating motion of arm part 61 by motion converter 60. Then, with the linear reciprocating motion of arm part 61, movable plate 45 is to reciprocate linearly with respect to fixed plate 46. Then, movable blade bar 452 reciprocatingly slides with respect to fixed blade bar 462, and hair H introduced between fixed blade groove 463 and movable blade groove 453 is sandwiched and cut by movable blade bar 452 and fixed blade bar 462.

Next, specific configurations of movable blade bar 452, fixed blade bar 462, movable blade groove 453, and fixed blade groove 463 will be described (see FIGS. 11 and 12).

Movable blade bar 452 is formed so as to project in one direction from main body 451, and includes root part 4521 that is continuously provided to main body 451. In the present exemplary embodiment, a direction orthogonal to a direction in which movable blade bar 452 projects (a projecting direction) is blade moving direction (the reciprocating sliding direction of the movable blade) W.

In addition, movable blade bar 452 includes bent part 4522 that is continuously provided to root part 4521 and bent such that a tip end side is to be the fixed plate 46 side, and cutter 4523 that is continuously provided to bent part 4522 and can cut hair H.

Whereas, fixed blade bar 462 is formed so as to project in one direction from main body 461, and includes root part 4621 that is continuously provided to main body 461. In the present exemplary embodiment, when movable plate 45 and fixed plate 46 are overlapped with each other, movable blade bar 452 and fixed blade bar 462 project in the same direction. Therefore, in an assembled state of blade unit 40, a direction in which fixed blade bar 462 projects (a projecting direction) is also a direction orthogonal to blade moving direction (the reciprocating sliding direction of the movable blade) W.

In addition, fixed blade bar 462 includes bent part 4622 that is continuously provided to root part 4621 and bent such that a tip end side is to be the movable plate 45 side, and cutter 4623 that is continuously provided to bent part 4622 and can cut hair H.

Figure 7:
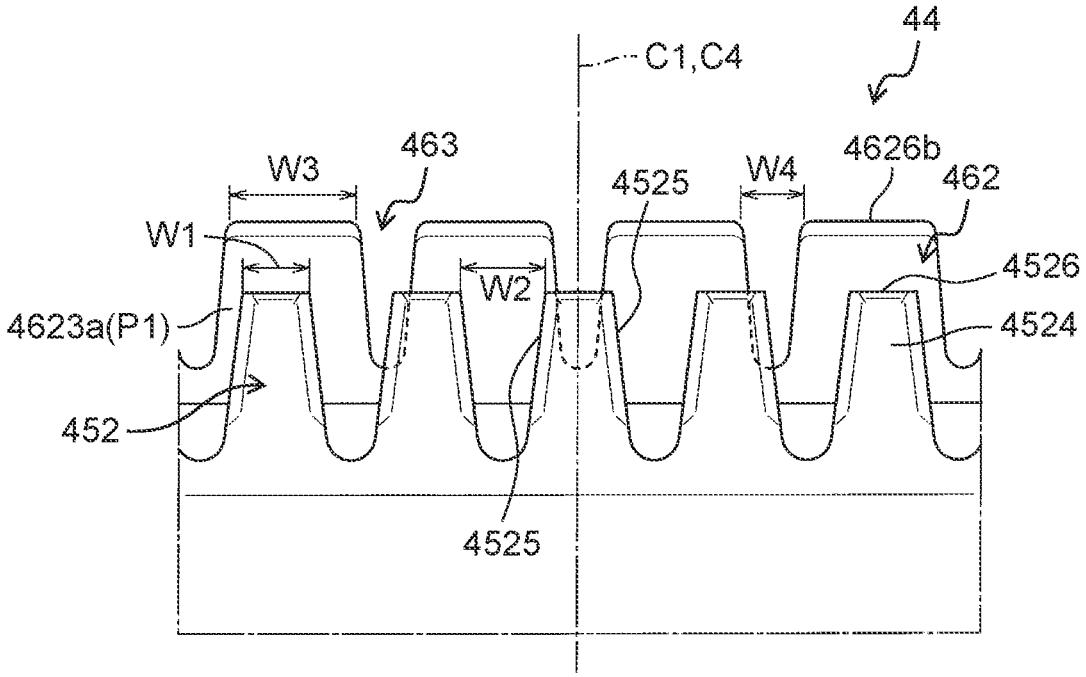
FIG. 7 is view of the fixed plate and the movable plate according to the exemplary embodiment when there is a state where a center of the movable blade bar in a reciprocating sliding direction coincides with a center of the fixed blade groove in the reciprocating sliding direction, as viewed from the movable-plate side along an overlapping direction of the fixed blade and the movable blade.
Figure 8:
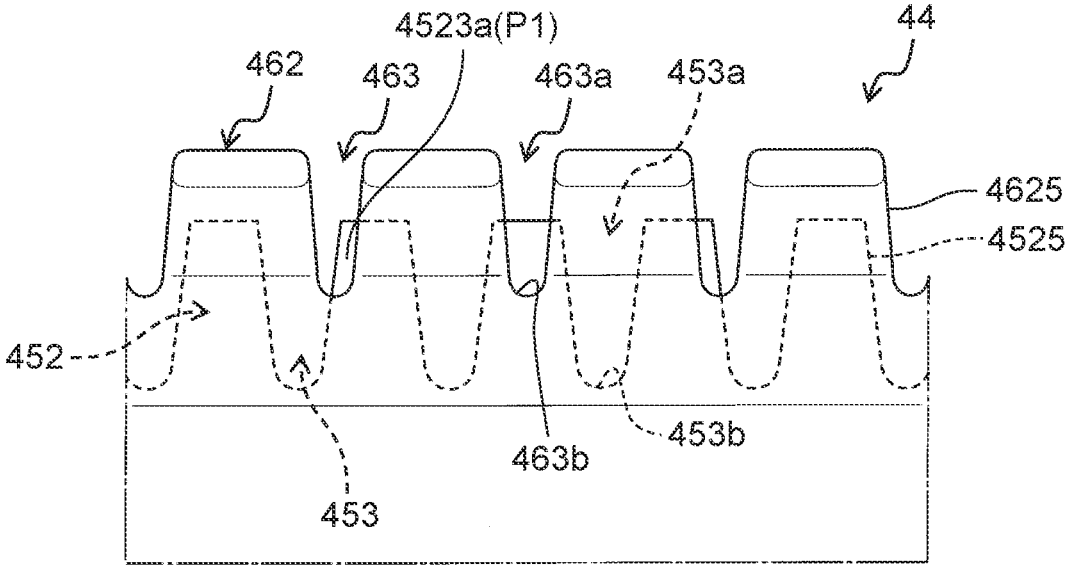
FIG. 8 is a view of the fixed plate and the movable plate according to the exemplary embodiment when there is a state where a center of the movable blade bar in the reciprocating sliding direction coincides with a center of the fixed blade groove in the reciprocating sliding direction, as viewed from the fixed-plate side along an overlapping direction of the fixed blade and the movable blade.
Figure 9:
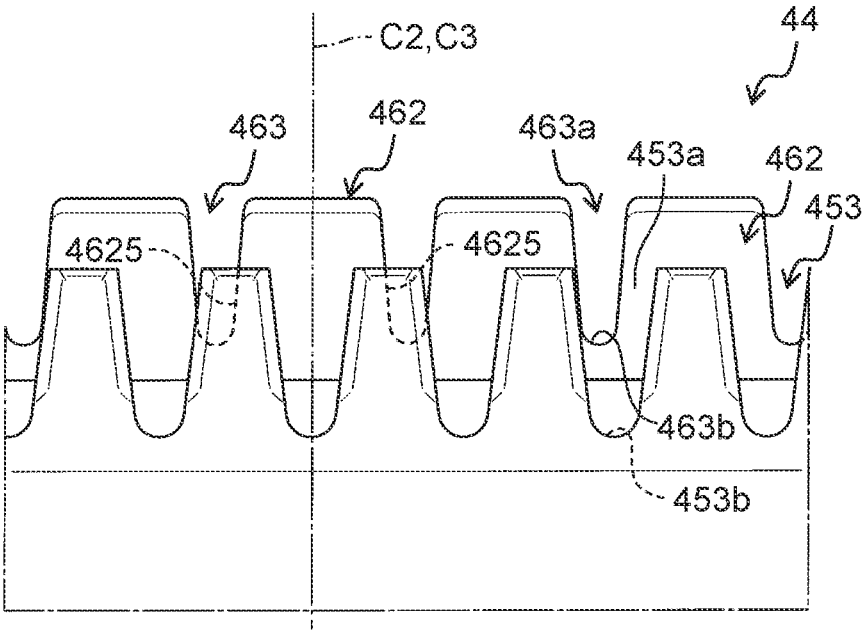
FIG. 9 is a view of the fixed plate and the movable plate according to the exemplary embodiment when there is a state where a center of the fixed blade bar in the reciprocaating sliding direction coincides with a center of the movable blade groove in the reciprocating sliding direction, as viewed from the movable-plate side along an overlapping direction of the fixed blade and the movable blade.
Figure 10:
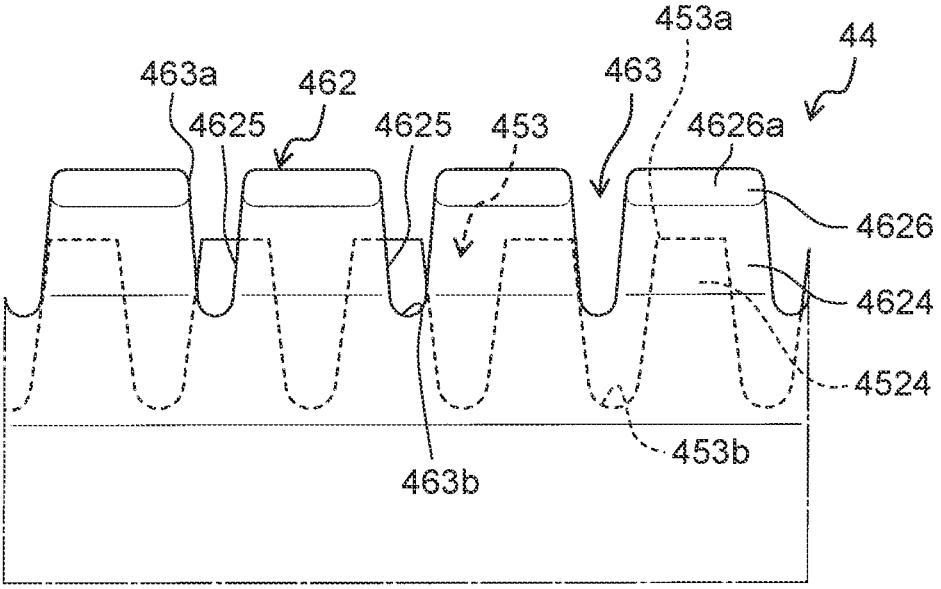
FIG. 10 is a view of the fixed plate and the movable plate according to the exemplary embodiment when there is a state where a center of the fixed blade bar in the reciprocating sliding direction coincides with a center of the movable blade groove in the reciprocating sliding direction, as viewed from the fixed-plate side along an overlapping direction of the fixed blade and the movable blade.

Then, in an assembled state of blade unit 40, opposing surface 4523*a* of cutter 4523 opposed to cutter 4623 is in contact with opposing surface 4623*a* of cutter 4623 opposed to cutter 4523 (see FIGS. 7 and 8). Therefore, in the present exemplary embodiment, opposing surface 4523*a* of cutter 4523 and opposing surface 4623*a* of cutter 4623 serve as sliding contact surface P1 that slides when movable plate 45 is reciprocated linearly with respect to fixed plate 46. As described above, in the present exemplary embodiment, movable blade bar 452 reciprocates with respect to fixed blade bar 462 in a state where opposing surface 4523*a* is in flat contact with opposing surface 4623*a*.

Movable blade groove 453 is formed so as to open on a tip end side of movable blade bar 452 in the projecting direction, between two movable blade bars 452 adjacent to each other in blade moving direction (the reciprocating sliding direction of the movable blade) W. That is, movable blade groove 453 has opening side 453*a* on the tip end 4526 side of movable blade bar 452, and depth side 453*b* on a root side of movable blade bar 452 (see FIGS. 7 and 8).

Whereas, fixed blade groove 463 is formed so as to open on a tip end side of fixed blade bar 462 in the projecting direction, between two fixed blade bars 462 adjacent to each other in blade moving direction (the reciprocating sliding direction of the movable blade) W. That is, fixed blade groove 463 has opening side 463*a* on the tip end 4626*b* side of fixed blade bar 462, and depth side 463*b* on a root side of fixed blade bar 462 (see FIGS. 7 and 8).

Then, movable blade bar 452 and fixed blade bar 462 are formed so as to have a tapered shape (see FIGS. 7 to 10) when viewed along an overlapping direction of movable plate 45 and fixed plate 46 (a thickness direction of movable blade bar 452 and fixed blade bar 462). That is, movable blade bar 452 and fixed blade bar 462 are formed with edges 4525, 4625 that are inclined with respect to the projecting direction of movable blade bar 452 and fixed blade bar 462, on both sides of blade moving direction (the reciprocating sliding direction of the movable blade) W. At least one of these edges 4525, 4625 desirably has a sharp edge so that hair H can be sandwiched and cut more reliably. In the present exemplary embodiment, a shape of movable blade bar 452 is made to be a shape with a chamfered edge part to achieve sharper edge 4525.

Further, in the present exemplary embodiment, by making a difference in tilt angles of movable blade bar 452 and fixed blade bar 462 with respect to the projecting direction, it makes possible to sandwich and cut hair H more reliably.

As described above, in the present exemplary embodiment, since movable blade bar 452 and fixed blade bar 462 are formed in a tapered shape, movable blade groove 453 and fixed blade groove 463 have a shape that expands toward opening sides 453*a*, 463*a*.

Specifically, movable blade groove 453 and fixed blade groove 463 are formed such that a blade groove angle of movable blade groove 453 and a blade groove angle of fixed blade groove 463 are positive angles with an intersection positioned on depth sides 453*b*, 463*b*. That is, movable blade groove 453 and fixed blade groove 463 are formed such that a groove width in blade moving direction (the reciprocating sliding direction of the movable blade) W increases from depth sides 453*b*, 463*b* toward opening sides 453*a*, 463*a*.

As described above, in the present exemplary embodiment, movable blade groove 453 and fixed blade groove 463 are formed such that a blade groove angle at least on opening sides 453*a*, 463*a* is to be a positive angle with an intersection positioned on depth sides 453*b*, 463*b*.

This configuration makes it possible to improve an introduction property of hair H into the blade groove and a lead-out property from the blade groove.

Figure 16:
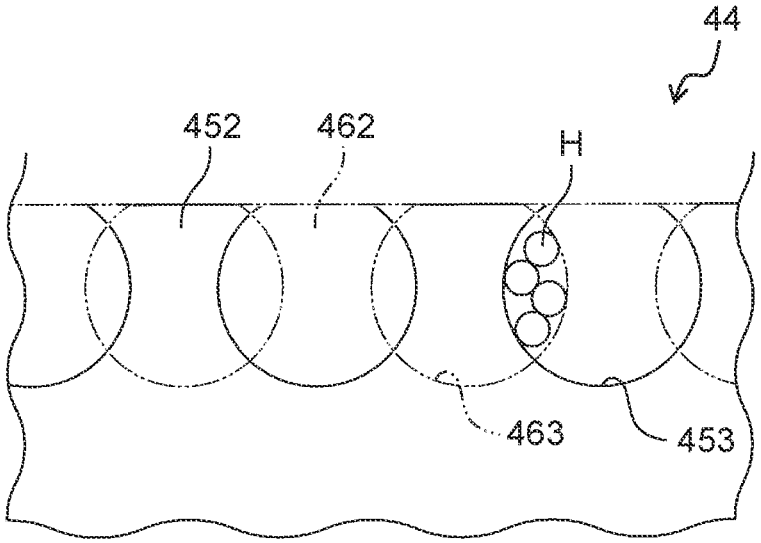
FIG. 16 is a view showing a fixed plate and a movable plate according to Comparative Example 2.

For example, FIG. 16 shows a state where movable blade groove 453 and fixed blade groove 463 are formed such that a blade groove angle on opening sides 453*a*, 463*a* is to be a negative angle with an intersection positioned on an outer side (a tip end side) of an opening.

Such a movable blade groove 453 and fixed blade groove 463 narrow a groove width at the opening, which deteriorates the introduction property of hair H into the blade groove. In addition, hair introduced into the blade groove is not easily discharged to outside, in this configuration. Therefore, in the configuration shown in FIG. 16, hair H remaining in the blade groove without being cut may be caught between movable blade bar 452 and fixed blade bar 462, which may cause inability to cut.

Whereas, in the present exemplary embodiment, movable blade groove 453 and fixed blade groove 463 have a widest groove width of the opening, and therefore hair H having been introduced into the blade groove but not been cut can be pushed out of the groove more smoothly. As a result, it is suppressed that hair H is caught between movable blade bar 452 and fixed blade bar 462, and it is possible to more reliably suppress inability to cut.

Note that, hair H is sandwiched and cut by movable blade bar 452 and fixed blade bar 462 by being introduced in a region where movable blade groove 453 and fixed blade groove 463 communicate with each other when movable blade bar 452 is reciprocally slid in blade moving direction (the reciprocating sliding direction of the movable blade) W.

Therefore, movable blade bar 452 has movable-side hair cutting region 4524 that is a portion overlapping with the region where movable blade groove 453 and fixed blade groove 463 communicate with each other when movable blade bar 452 is reciprocally slid in blade moving direction (the reciprocating sliding direction of the movable blade) W. In addition, fixed blade bar 462 has fixed-side hair cutting region 4624 that is a portion overlapping with the region where movable blade groove 453 and fixed blade groove 463 communicate with each other when movable blade bar 452 is reciprocally slid in blade moving direction (the reciprocating sliding direction of the movable blade) W.

Further, in the present exemplary embodiment, fixed blade bar 462 is made project outward from movable blade bar 452. That is, tip end 4626*b* of fixed blade bar 462 is positioned outside from tip end 4526 of movable blade bar 452.

Further, depth side 463*b* of fixed blade groove 463 is positioned closer to a tip end side than depth side 453*b* of movable blade groove 463.

Then, tip end 4526 of movable blade bar 452 is positioned closer to a tip end side than depth side 463*b* of fixed blade groove 463.

Therefore, the present exemplary embodiment has movable-side hair cutting region 4524 that is a portion between tip end 4526 of movable blade bar 452 and depth side 463*b* of fixed blade groove 463, in movable blade bar 452. Further, a portion between tip end 4526 of movable blade bar 452 and depth side 463*b* of fixed blade groove 463 in fixed blade bar 462 is fixed-side hair cutting region 4624.

As described above, in the present exemplary embodiment, fixed blade bar 462 includes fixed-side hair cutting region 4624 capable of cutting hair H, and tip end part 4626 positioned closer to a tip end side than fixed-side hair cutting region 4624.

Figure 11:
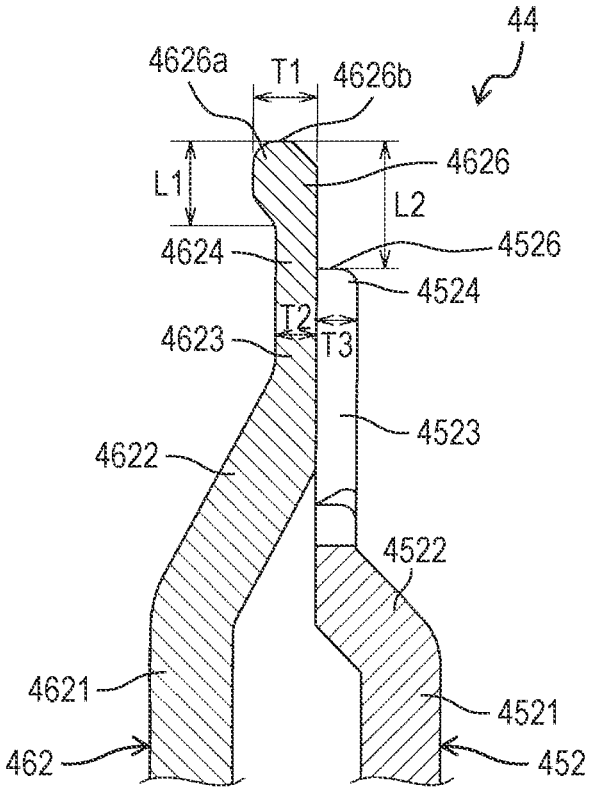
FIG. 11 is a cross-sectional view showing the fixed blade bar and the movable blade bar according to the exemplary embodiment.

Then, at tip end part 4626 of fixed blade bar 462, thick part 4626*a* having thickness T1 thicker than thickness T2 of fixed-side hair cutting region 4624 is formed (see FIG. 11). In the present exemplary embodiment, thick part 4626*a* is formed by projecting of tip end part 4626 of fixed blade bar 462 to a side opposite to the movable blade bar 452 side. With this configuration, thick part 4626*a* is to be applied on skin (skin surface) S at a time of use with the fixed plate (fixed blade) 46 side of blade part (the blade of the hair removal device) 44 applied on skin (skin surface) S, which lakes it possible to improve safety during use and improve feel on the skin.

As described above, in the present exemplary embodiment, movable blade bar 452 and fixed blade bar 462 are arranged such that tip end 4626*b* of fixed blade bar 462 projects outward from tip end 4526 of movable blade bar 452. Further, in the present exemplary embodiment, length L1 of fixed blade bar 462 of thick part 4626*a* in the projecting direction is made shorter than length L2 from tip end 4626*b* of fixed blade bar 462 to tip end 4526 of movable blade bar 452 (see FIG. 11.). This configuration allows movable-side hair cutting region 4524 of movable blade bar 452 to be arranged in a thin region (fixed-side hair cutting region 4624) of fixed blade bar 462, which makes it possible to cut hair more reliably.

Further, in the present exemplary embodiment, thickness T3 of movable-side hair cutting region 4524 and thickness T2 of fixed-side hair cutting region 4624 are made to be substantially equal. This configuration can achieve a more uniform cut height regardless of whether the movable plate (movable blade) 45 side or the fixed plate (fixed blade) 46 side is applied on skin (skin surface) S.

Figure 12:
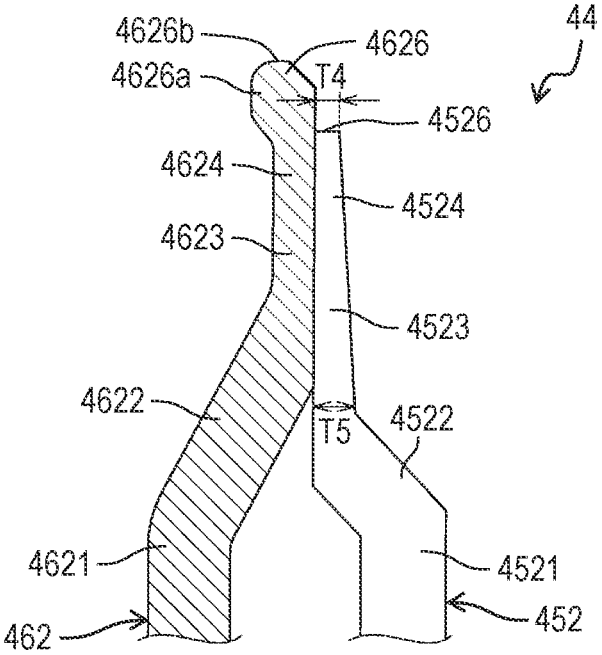
FIG. 12 is a cross-sectional view showing a fixed blade bar and a movable blade bar according to a modified example.

Note that, as shown in FIG. 12, it is also possible to form movable blade bar 452 such that thickness T4 on the tip end side is thinner than thickness T5 on the root side. This allows hair H to be cut shorter when the movable plate (movable blade) 45 side is applied on skin (skin surface) S to cut hair H.

At this time, a shape of fixed blade bar 462 may also be formed such that a thickness on the tip end side is thinner than a thickness on the root side. Then, thickness T4 on the tip end side of movable blade bar 452 and the thickness on the tip end side of fixed blade bar 462 may be made substantially equal to each other, and thickness T5 on the root side of movable blade bar 452 and the thickness on the root side of fixed blade bar 462 may be made substantially equal to each other.

Further, in the present exemplary embodiment, bar width W1 of movable blade bar 452 in blade moving direction (the reciprocating sliding direction of the movable blade) W is made larger than groove width W4 of fixed blade groove 463 in blade moving direction (the reciprocating sliding direction of the movable blade) W.

In this way, by making bar width W1 of movable blade bar 452 larger than groove width W4 of fixed blade groove 463, it is possible to inhibit an entire cutting edge of movable blade bar 452 from being positioned in fixed blade groove 463 regardless of a position of movable blade bar 452 in a reciprocating sliding region.

In particular, in the present exemplary embodiment, bar width W1 at tip end 4526 of movable blade bar 452 is made larger than groove width W4 at the opening of fixed blade groove 463. That is, bar width W1 at tip end 4526 that is narrowest in movable blade bar 452 is made larger than groove width W4 at the opening that is widest in fixed blade groove 463.

Therefore, it is possible to more reliably inhibit the entire cutting edge of movable blade bar 452 from being positioned in fixed blade groove 463.

In the present exemplary embodiment, edges 4525 on both sides of movable-side hair cutting region 4524 in the reciprocating sliding direction are overlapped with fixed-side hair cutting region 4624 when center C1 of movable blade bar 452 in the reciprocating sliding direction is made coincident with center C1 of fixed blade groove 463 in the reciprocating sliding direction.

With this configuration, when an area of movable-side hair cutting region 4524 facing fixed blade groove 463 is maximized, edges 4525 on both sides are brought into contact with fixed-side hair cutting region 4624, which makes it possible to suppress deformation of movable blade bar 452 more reliably.

Further, bar width W3 of fixed blade bar 462 in blade moving direction (the reciprocating sliding direction of the movable blade) W is made larger than groove width W2 of movable blade groove 453 in blade moving direction (the reciprocating sliding direction of the movable blade) W.

In this way, by making bar width W3 of fixed blade bar 462 larger than groove width W2 of movable blade groove 453, it is possible to inhibit an entire cutting edge of fixed blade bar 462 from being positioned in movable blade groove 453, regardless of a position of movable blade bar 452 in the reciprocating sliding region.

In particular, in the present exemplary embodiment, bar width W3 at tip end 4626*b* of fixed blade bar 462 is made larger than groove width W2 at an opening of movable blade groove 453. That is, bar width W3 at tip end 4626*b* that is narrowest in fixed blade bar 462 is made larger than groove width W2 at the opening that is widest in movable blade groove 453.

Therefore, it is possible to more reliably inhibit the entire cutting edge of fixed blade bar 462 from being positioned in movable blade groove 453.

In the present exemplary embodiment, edges 4625 on both sides of fixed-side hair cutting region 4624 in the reciprocating sliding direction are overlapped with movable-side hair cutting region 4524 when center C3 of fixed blade bar 462 in the reciprocating sliding direction is made coincident with center C2 of movable blade groove 453 in the reciprocating sliding direction.

With this configuration, when an area of fixed-side hair cutting region 4624 facing movable blade groove 453 is maximized, edges 4625 on both sides are brought into contact with movable-side hair cutting region 4524, which makes it possible to suppress deformation of fixed blade bar 462 more reliably.

As described above, when the configuration according to the present exemplary embodiment is adopted, movable blade bar 452 and fixed blade bar 462 can be supported by surfaces (opposing surface 4523*a* and opposing surface 4623*a*) including edges 4525, 4625 no matter where movable plate (movable blade) 45 is positioned regardless of whether trimmer 10 is driven or stopped. Therefore, a strength of blade part (the blade of the hair removal device) 44 can be made sufficient.

Figure 15:
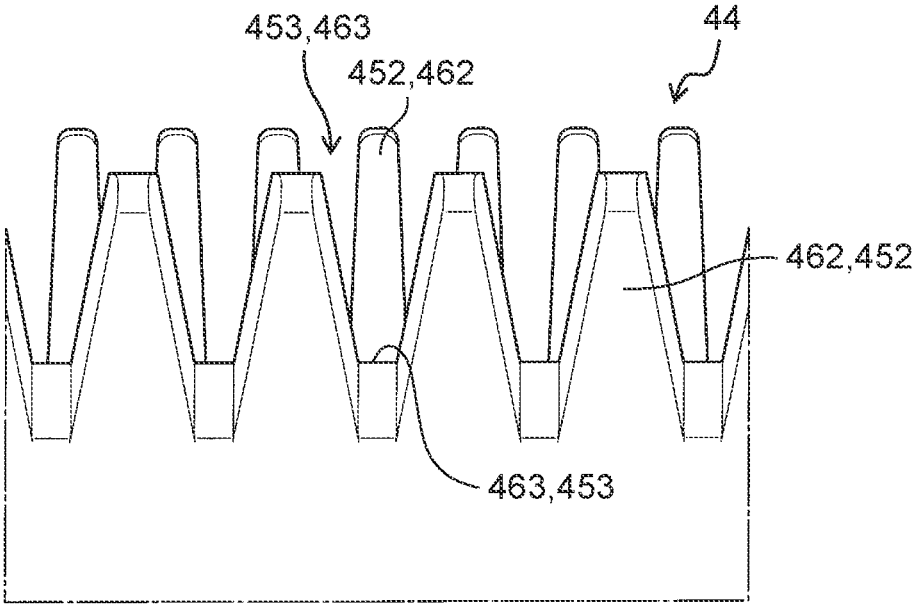
FIG. 15 is a view showing a fixed plate and a movable plate according to Comparative Example 1.

For example, FIG. 15 exemplifies a configuration in which there is the entire cutting edge of movable blade bar 452 or fixed blade bar 462 positioned in fixed blade groove 463 or movable blade groove 453 when movable blade bar 452 is at any position in the reciprocating sliding region.

With such a configuration, when the cutting edge receives a concentrated force from the outside due to collision with an edge of a desk, and the like in a state where the entire cutting edge is positioned in the blade groove, movable blade bar 452 or fixed blade bar 462 may be deformed.

Then, when movable blade bar 452 or fixed blade bar 462 is bent toward another bar, movable blade bar 452 and fixed blade bar 462 interfere with each other, which may increase a drive load or cause a temperature rise due to an increase in frictional heat. Then, if driving power is spent on an event other than cutting due to interference between movable blade bar 452 and fixed blade bar 462, sharpness of blade part 44 may be deteriorated.

Whereas, if movable blade bar 452 or fixed blade bar 462 is deformed toward an opposite side of the other bar, there is a possibility that a gap will be created between movable blade bar 452 and fixed blade bar 462, and the sharpness is deteriorated.

On the other hand, in the present exemplary embodiment, regardless of the position of movable plate (movable blade) 45, movable blade bar 452 and fixed blade bar 462 can be supported by surfaces (opposing surface 4523*a* and opposing surface 4623*a*) including edges 4525, 4625. Therefore, it becomes possible to suppress deformation of movable blade bar 452 or fixed blade bar 462 more reliably, and to suppress interference between movable blade bar 452 and fixed blade bar 462 as much as possible.

[Operational effect]

Hereinafter, a characteristic configuration of the blade of the hair removal device and the hair removal device shown in each exemplary embodiment described above and effects obtained by the blade of the hair removal device and the hair removal device will be described.

(1) The blade of the hair removal device shown in the above exemplary embodiment includes a fixed blade and a movable blade that reciprocatingly slides with respect to the fixed blade, and the blade of the hair removal device cuts hair with the fixed blade and the movable blade.

Further, the fixed blade has a plurality of fixed blade bars arranged side by side in a reciprocating sliding direction of the movable blade with respect to the fixed blade, and a plurality of fixed blade grooves arranged side by side in the reciprocating sliding direction.

Further, the movable blade has a plurality of movable blade bars arranged side by side in the reciprocating sliding direction, and a plurality of movable blade grooves arranged side by side in the reciprocating sliding direction.

Further, the movable blade bar is formed such that a bar width in the reciprocating sliding direction is larger than a groove width of the fixed blade groove in the reciprocating sliding direction.

Further, the fixed blade bar is formed such that a bar width in the reciprocating sliding direction is larger than a groove width of the movable blade groove in the reciprocating sliding direction.

The fixed blade groove and the movable blade groove are formed such that a blade groove angle at least on an opening side is a positive angle with an intersection positioned on a depth side.

In this way, when the movable blade bar is formed such that the bar width in the reciprocating sliding direction is larger than the groove width of the fixed blade groove in the reciprocating sliding direction, an entire cutting edge of the movable blade bar will not be positioned in the fixed blade groove, regardless of a position of the movable blade bar in the reciprocating sliding region.

Further, when the fixed blade bar is formed such that the bar width in the reciprocating sliding direction is larger than the groove width of the movable blade groove in the reciprocating sliding direction, an entire cutting edge of the fixed blade bar will not be positioned in the movable blade groove, regardless of a position of the movable blade bar in the reciprocating sliding region.

That is, no matter where the movable blade is positioned regardless of whether the hair removal device is driven or stopped, the movable blade bar and the fixed blade, bar can be supported by a surface including an edge. Therefore, a strength of the blade of the hair removal device can be made sufficient.

As a result, deformation of the blade of the hair removal device is more reliably suppressed, and interference between the fixed blade and the movable blade can be suppressed as much as possible.

As described above, the configuration of (1) above makes it possible to obtain a blade of a hair removal device capable of more reliably suppressing deformation.

Further, when the fixed blade groove and the movable blade groove are formed such that a blade groove angle at least on an opening side is a positive angle with an intersection positioned on a depth side, it is possible to inhibit introduction of the hair into the blade groove and lead-out of the hair from the blade groove from being obstructed on the opening side. That is, it becomes possible to further improve the introduction property of the hair into the blade groove and the lead-out property of the hair from the blade groove.

(2) Further, in the blade of the hair removal device according to (1) above, the fixed blade groove and the movable blade groove may be formed such that a groove width in the reciprocating sliding direction increases from a depth side toward an opening side.

This configuration makes it possible to further improve the introduction property of the hair into the blade groove and the lead-out property of the hair from the blade groove.

(3) Further, in the blade of the hair removal device according to (1) or (2) above, the movable blade bar may be formed such that a thickness on a tip end side is thinner than a thickness on a root side.

This configuration makes it possible to cut the hair shorter when the movable blade side is applied on the skin to cut the hair.

(4) Further, in the blade of the hair removal device according to any one of (1) to (3) above, the fixed blade bar may include a fixed-side hair cutting region capable of cutting hair and a tip end part positioned closer to a tip end side than the fixed-side hair cutting region. Then, at the tip end part of the fixed blade bar, a thick part, having a thickness larger than a thickness of the fixed-side hair cutting region may be formed.

In this way, when the thickness of the tip end part of the fixed blade bar is made thicker than the thickness of the region that cuts the hair in the fixed blade bar, the thickness of the region that cuts the hair can be reduced, and the thickness of the tip end part to be in contact with the skin can be increased. As a result, it is possible to improve safety and feel of touching the skin while allowing the hair to be cut shorter.

(5) Further, in the blade of the hair removal device in (4) above, the fixed blade bar and the movable blade bar may be arranged such that a tip end of the fixed blade bar projects outward from a tip end of the movable blade bar. Then, a length of the thick part in the projecting direction of the fixed blade bar may be made shorter than a length from the tip end of the fixed blade bar to the tip end of the movable blade bar.

In this way, when the cut area of the movable blade bar is arranged in a thin region of the fixed blade bar, the hair can be cut more reliably.

(6) Further, in the blade of the hair removal device according to any one of (1) to (5) above, the fixed blade bar may include a fixed-side hair cutting region capable of cutting hair, and the movable blade bar may include a movable-side hair cutting region capable of cutting hair. Then, a thickness of the movable-side hair cutting region and a thickness of the fixed-side hair cutting region may be substantially equal.

This configuration makes it possible to achieve a more uniform cut height regardless of whether the movable blade side or the fixed blade side is applied on the skin.

(7) Further, the blade of the hair removal device shown in the above exemplary embodiment includes a fixed blade and a movable blade that reciprocatingly slides with respect to the fixed blade, and the blade of the hair removal device cuts hair with the fixed blade and the movable blade.

Further, the fixed blade has a plurality of fixed blade bars arranged side by side in a reciprocating sliding direction of the movable blade with respect to the fixed blade, and a plurality of fixed blade grooves arranged side by side in the reciprocating sliding direction.

Further, the movable blade has a plurality of movable blade bars arranged side by side in the reciprocating sliding direction, and a plurality of movable blade grooves arranged side by side in the reciprocating sliding direction.

Further, the fixed blade bar includes a fixed-side hair cutting region capable of cutting hair, and the movable blade bar includes a movable-side hair cutting region capable of cutting hair.

Further, when a center of the movable blade bar in the reciprocating sliding direction is made coincident with a center of the fixed blade groove in the reciprocating sliding direction in viewing along an overlapping direction of the fixed blade and the movable blade, edges on both sides of the movable-side hair cutting region in the reciprocating sliding direction are overlapped with the fixed-side hair cutting region.

Further, when a center of the fixed blade bar in the reciprocating sliding direction is made coincident with a center of the movable blade groove in the reciprocating sliding direction viewing along an overlapping direction of the fixed blade and the movable blade, edges on both sides of the fixed-side hair cutting region in the reciprocating sliding direction are overlapped with the movable-side hair cutting region.

With this configuration, when an area of the movable-side hair cutting region facing the fixed blade bar is maximized, the edges on both sides come into contact with the fixed-side hair cutting region, which makes it possible to suppress deformation of the movable blade bar more reliably.

Further, when an area of the fixed-side hair cutting region facing the movable blade bar is maximized, the edges on both sides come into contact with the movable-side hair cutting region. Therefore, it is possible to suppress deformation of the fixed blade bar more reliably.

That is, with the configuration of (7) above, it is possible to obtain a blade of a hair removal device capable of more reliably suppressing deformation.

(8) Further, in the blade of the hair removal device according to any one of (1) to (7) above, the movable blade may be pressed toward the fixed blade side by a pressing spring.

This configuration makes it possible to bring the movable blade bar more reliably into sliding contact with the fixed blade bar, and to further improve a hair cutting performance. Further, adopting the configuration shown in the above exemplary embodiment makes it possible to suppress deformation of the blade of the hair removal device more reliably. Therefore, the movable blade and the fixed blade can be made thinner, and a pressing force by the pressing spring can be further improved.

(9) Further, the hair removal device shown in the above exemplary embodiment includes the blade of the hair removal device according to any one of (1) to (8) above.

This configuration makes it possible to obtain a hair removal device capable of more reliably suppressing deformation of the blade of the hair removal device.

[Other]

The contents of the blade of the hair removal device and the hair removal device including the blade of the hair removal device according to the present disclosure have been described above, but it is obvious to those skilled in the art that various modifications and improvements are possible without limitation to the descriptions.

For example, in the above exemplary embodiment, as a hair removal device, trimmer 10 is exemplified in which angle θ1 formed by the moving direction of movable blade 45 with respect to fixed blade 46 and the longitudinal direction of grip part 20 is an acute angle. However, the hair removal device is not limited to trimmer 10 shown in the above exemplary embodiment, and the present disclosure can be applied to various types of hair removal devices. For example, the present disclosure can be applied to a hair clipper (trimmer) in which an angle formed by the moving direction of the movable blade with respect to the fixed blade and the longitudinal direction of the grip part is a right angle.

In addition, specifications (a shape, a size, a layout, and the like) of the head part and the grip part, and other details can be changed as appropriate.

As described above, the blade of the hair removal device and the hair removal device including the blade according to the present disclosure are capable of suppressing deformation of the blade. Therefore, it is possible to use for various blades of hair removal devices for home use and commercial use and for the hair removal device provided with the blade.

What is claimed is:

1. A blade part for a hair removal device, the blade part comprising:

a fixed blade; and a movable blade that reciprocatingly slides with respect to the fixed blade, the blade part being adapted to cut hair with the fixed blade and the movable blade, wherein the fixed blade has a plurality of fixed blade bars arranged side by side in a reciprocating sliding direction of the movable blade with respect to the fixed blade, and a plurality of fixed blade grooves arranged side by side in the reciprocating sliding direction, the movable blade has a plurality of movable blade bars arranged side by side in the reciprocating sliding direction, and a plurality of movable blade grooves arranged side by side in the reciprocating sliding direction, each of the movable blade bars is formed to have a bar width in the reciprocating sliding direction to be larger than a groove width of each of the fixed blade grooves in the reciprocating sliding direction, each of the fixed blade bars is formed to have a bar width in the reciprocating sliding direction to be larger than a groove width of each of the movable blade grooves in the reciprocating sliding direction, the groove width of each of the fixed blade grooves in the reciprocating sliding direction is increased in a direction from a base of each fixed blade bar towards a tip end of each fixed blade bar, and the groove width of each of the movable blade grooves in the reciprocating sliding direction is increased in a direction from a base of each movable blade bar towards a tip end of each movable blade bar.

2. The blade part for the hair removal device according to claim 1, wherein a thickness of each of the movable blade bars is less at a tip end side of each of the movable blade bars compared to a thickness of each of the movable blade bars at the base of each of the movable blade bars.

3. The blade part for the hair removal device according to claim 1, wherein each of the fixed blade bars includes a fixed-side hair cutting region capable of cutting hair and a tip end part positioned closer to a tip end side of each of the fixed blade bars than the fixed-side hair cutting region, and at the tip end part of each of the fixed blade bars, a thick part having a thickness larger than a thickness of the fixed-side hair cutting region is formed.

4. The blade part for the hair removal device according to claim 3, wherein each of the fixed blade bars and each of the movable blade bars are arranged such that the tip end of each of the fixed blade bars projects outward beyond the tip end of each of the movable blade bars, and a length of the thick part in a projecting direction of each of the fixed blade bars is shorter than a length from the tip end of each of the fixed blade bars to the tip end of each of the movable blade bars.

5. The blade part for the hair removal device according to claim 1, wherein each of the fixed blade bars includes a fixed-side hair cutting region capable of cutting hair, each of the movable blade bars includes a movable-side hair cutting region capable of cutting hair, and a thickness of the movable-side hair cutting region and a thickness of the fixed-side hair cutting region are substantially equal.

6. The blade part for the hair removal device according to claim 1, wherein the movable blade is pressed against the fixed blade by a pressing spring.

7. A hair removal device comprising the blade part according to claim 1.

8. A blade part for a hair removal device, the blade part comprising:

a fixed blade; and a movable blade that reciprocatingly slides with respect to the fixed blade, the blade part being adapted to cut hair with the fixed blade and the movable blade, wherein the fixed blade has a plurality of fixed blade bars arranged side by side in a reciprocating sliding direction of the movable blade with respect to the fixed blade, and a plurality of fixed blade grooves arranged side by side in the reciprocating sliding direction, the movable blade has a plurality of movable blade bars arranged side by side in the reciprocating sliding direction, and a plurality of movable blade grooves arranged side by side in the reciprocating sliding direction, each of the fixed blade bars includes a fixed-side hair cutting region capable of cutting hair, each of the movable blade bars includes a movable-side hair cutting region capable of cutting hair, when a center of one of the movable blade bars in the reciprocating sliding direction is made coincident with a center of one of the fixed blade grooves in the reciprocating sliding direction in viewing along an overlapping direction of the fixed blade and the movable blade, edges on both sides of the movable-side hair cutting region in the reciprocating sliding direction are overlapped with the fixed-side hair cutting region, when a center of one of the fixed blade bars in the reciprocating sliding direction is made coincident with a center of one of the movable blade grooves in the reciprocating sliding direction in viewing along an overlapping direction of the fixed blade and the movable blade, edges on both sides of the fixed-side hair cutting region in the reciprocating sliding direction are overlapped with the movable-side hair cutting region, (1) widths of at least two fixed blade bars of the plurality of fixed blade bars in the reciprocating sliding direction are the same, except for the ones at opposite ends of the fixed blade, and (2) widths of the plurality of fixed blade grooves are the same in the reciprocating sliding direction, (1) widths of the plurality of movable blade bars are the same in the reciprocating sliding direction, and (2) widths of the plurality of movable blade grooves the are the same in the reciprocating sliding direction, and the widths of the movable blade grooves are different from the widths of the fixed blade grooves.

9. The blade part for the hair removal device according to claim 8, wherein the movable blade is pressed against the fixed blade by a pressing spring.

10. A hair removal device comprising the blade part according to claim 8.

11. The blade part for the hair removal device according to claim 8, wherein widths of all the plurality of fixed blade bars are the same, except for the ones at opposite ends of the fixed blade in the reciprocating sliding direction.

* * * * *